US007424258B2

(12) United States Patent
Sugawara et al.

(10) Patent No.: US 7,424,258 B2
(45) Date of Patent: Sep. 9, 2008

(54) TRANSFER DEVICE AND IMAGE FORMING DEVICE THAT INCLUDE A TRANSFER ASSISTING BLADE HAVING A SLANT PORTION FOR ABUTTING A RECORDING MEDIUM

(75) Inventors: Hirokatsu Sugawara, Saitama (JP); Takeharu Nagai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 11/377,429

(22) Filed: Mar. 17, 2006

(65) Prior Publication Data

US 2006/0216075 A1 Sep. 28, 2006

(30) Foreign Application Priority Data

Mar. 23, 2005 (JP) ..... 2005-084868

(51) Int. Cl.
*G03G 15/16* (2006.01)

(52) U.S. Cl. ..... 399/316; 399/317

(58) Field of Classification Search ..... 399/310–312, 399/316, 317
See application file for complete search history.

(56) References Cited

U.S. PATENT DOCUMENTS 6,233,423 B1 * 5/2001 Fletcher et al. ..... 399/310
7,092,663 B2 * 8/2006 Takahashi et al. ..... 399/316
7,356,297 B2 * 4/2008 Montfort et al. ..... 399/316

FOREIGN PATENT DOCUMENTS

JP A 2000-242092 9/2000

* cited by examiner

*Primary Examiner*—William J Royer
(74) *Attorney, Agent, or Firm*—Oliff & Berridge, PLC

(57) ABSTRACT

A transfer device for transferring a toner image formed on an image carrier onto a recording sheet includes a transfer assisting blade adapted to abut the recording sheet and press the recording sheet against the image carrier, the transfer assisting blade having a slant formed in a transverse direction of the blade at a front end of the blade which end is for abutment against the recording sheet, the slant having an angle relative to an advancing direction of the recording sheet.

20 Claims, 16 Drawing Sheets

TRANSFER DEVICE AND IMAGE FORMING DEVICE THAT INCLUDE A TRANSFER ASSISTING BLADE HAVING A SLANT PORTION FOR ABUTTING A RECORDING MEDIUM

CROSS-REFERENCE TO RELATED APPLICATION

This application claims priority under 35 USC 119 from Japanese Patent Application No. 2005-084868, the disclosure of which is incorporated by reference herein.

BACKGROUND

1. Technical Field

The present invention relates to a transfer device and an image forming device provided with the transfer device.

2. Related Art

In an electrophotographic image forming device, first, an image carrier such as a photosensitive body is electrically charged uniformly by a charging device, followed by exposure using an exposure device to form an electrostatic latent image. The electrostatic latent image thus formed is subjected to development using a developing device, whereby a toner image is formed on the image carrier. The toner image thus formed on the image carrier is transferred onto a recording sheet by a transfer device. The recording sheet with the toner image transferred thereon is subjected to fixing by a fixing device.

As the transfer device for transferring a toner image onto a recording sheet there is known, for example, corotron which transfers a toner image onto the recording sheet electrostatically without contacting the recording sheet and the image carrier. In such a non-contact type transfer device, the contact between the image carrier and the recording sheet becomes non-uniform and there may occur a lowering of transfer efficiency or a defective transfer.

To avoid the occurrence of such an inconvenience, there has been proposed a method wherein a transfer assisting blade is provided on an upstream side of the corotron to press the recording sheet against and into close contact with the image carrier (see, for example, Japanese Published Unexamined Patent Application No. 2000-242092).

However, as shown in FIG. 16A, if a recording sheet P wrinkles at X, it may be impossible to fully remove the wrinkles X because a front end 1022A of a conventional transfer assisting blade 1022 is in simultaneous and uniform abutment against the recording sheet P in the transverse direction of the sheet, as shown in FIG. 16B.

Consequently, in each wrinkled portion x shown in FIG. 16B, there arises a space (air gap) between the recording sheet P and the image carrier, and as the case may be there occurs a phenomenon that a part of a toner image is not transferred to the recording sheet P and a part of the image is dropped out. For this reason it is desired to further improve the adhesion between the image carrier and the recording sheet.

The above description is based on knowledge of the present inventors and not necessarily that known in the art.

SUMMARY

According to an aspect of the present invention, there is provided a transfer device for transferring a toner image formed on an image carrier onto a recording sheet, the transfer device including a transfer assisting blade adapted to abut the recording sheet and press the recording sheet against the image carrier, the transfer assisting blade having a slant formed in a transverse direction of the blade at a front end of the blade which end is for abutment against the recording sheet, the slant having an angle relative to an advancing direction of the recording sheet.

According to another aspect of the present invention, there is provided a transfer device for transferring a toner image formed on an image carrier onto a recording sheet, the transfer device including plural transfer assisting blades adapted to abut the recording sheet and press the recording sheet against the image carrier, the transfer assisting blades being disposed spacedly in an advancing direction of the recording sheet, at least one of the transfer assisting blades having a slant formed in a transverse direction of the blade at a front end of the blade which end is for abutment against the recording sheet, the slant having an angle relative to the advancing direction of the recording sheet.

According to another aspect of the present invention, there is provided an image forming device including the transfer device described in any of the above aspects of the invention.

BRIEF DESCRIPTION OF THE DRAWINGS

Embodiments of the present invention will be described in detail based on the following figures, wherein.

DETAILED DESCRIPTION

Figure 1:
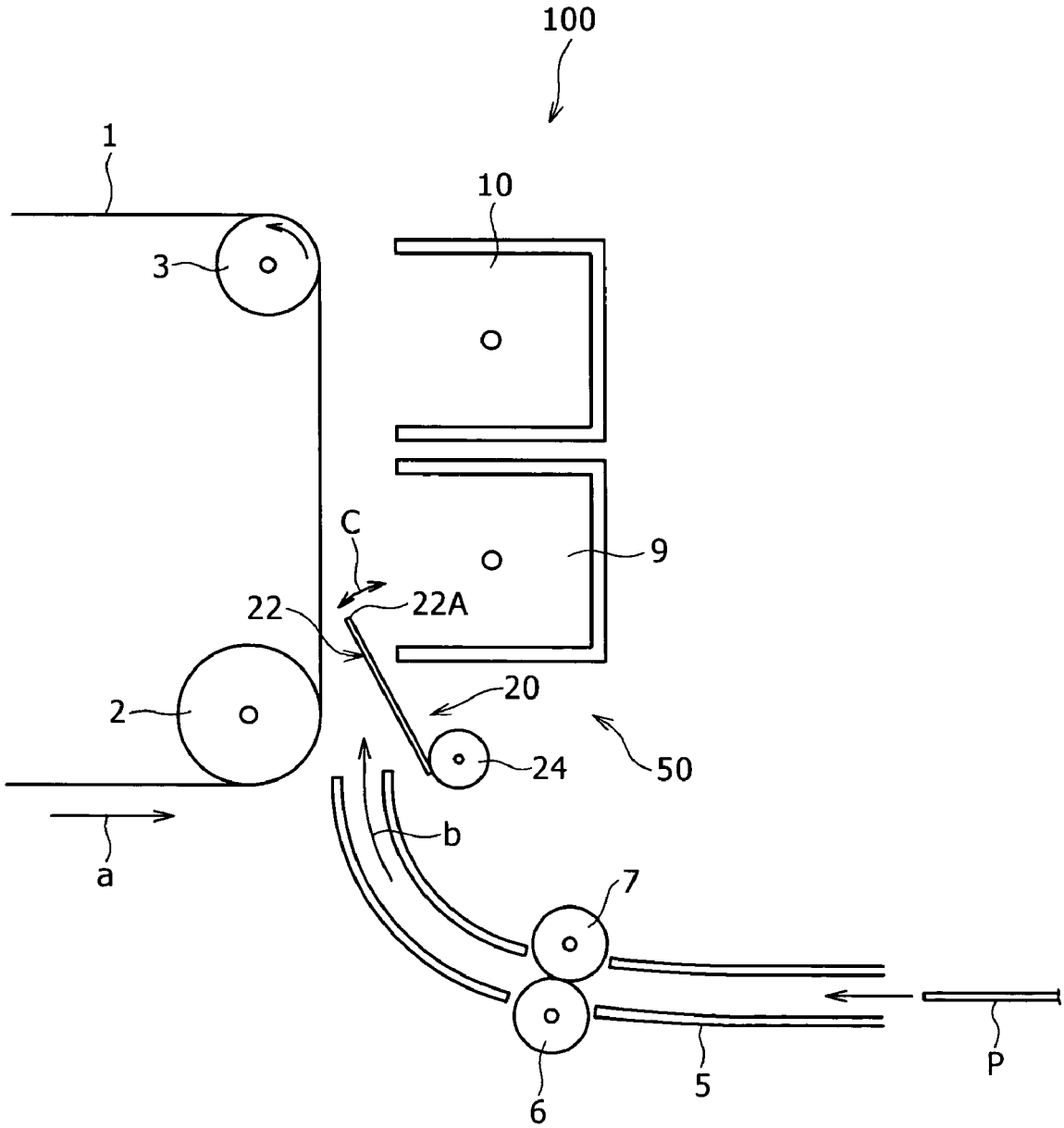
FIG. 1 illustrates schematically a principal portion of an image forming device provided with a transfer device according to a first embodiment of the present invention, in which a front end of a transfer assisting blade is in a first position spaced away from a photosensitive body.

FIG. 1 illustrates schematically a principal portion of an image forming device 100 provided with a transfer device 50 according to a first embodiment of the present invention.

A belt-like photosensitive body 1 is supported by a rotating roll 2 and a driving roll 3 and is conveyed in the direction of arrow a while being electrically charged uniformly by a charging device (not shown). The charging is followed by exposure using an exposure device (not shown) to form an electrostatic latent image, which is then subjected to development using a developing device (not shown) to form a toner image on the photosensitive body 1.

On the other hand, a recording sheet P is fed along a guide member 5 by a sheet feeder (not shown) and is conveyed to a position between the photosensitive body 1 and the transfer device 50 at predetermined timing by resist rollers 6 and 7 (See the arrow b).

The transfer device 50 includes a transfer corotron 9 and a release corotron 10, further including a transfer assisting mechanism 20 upstream and in the vicinity of the transfer corotron 9.

Using corona discharge, the transfer corotron 9 transfers the toner image on the photosensitive body 1 onto the recording sheet P while contacting neither the recording sheet P nor the photosensitive body 1.

The transfer assisting mechanism 20 includes a rotating shaft 24, and a transfer assisting blade 22 having elasticity is attached to the rotating shaft 24. The rotating shaft 24 is connected to a drive mechanism (not shown) to pivotally move a front end 22A of the transfer assisting blade 22 (see the arrow c).

As shown in FIG. 1, the front end 22A of the transfer assisting blade 22 normally lies in a first position spaced away from the photosensitive body 1.

Figure 2:
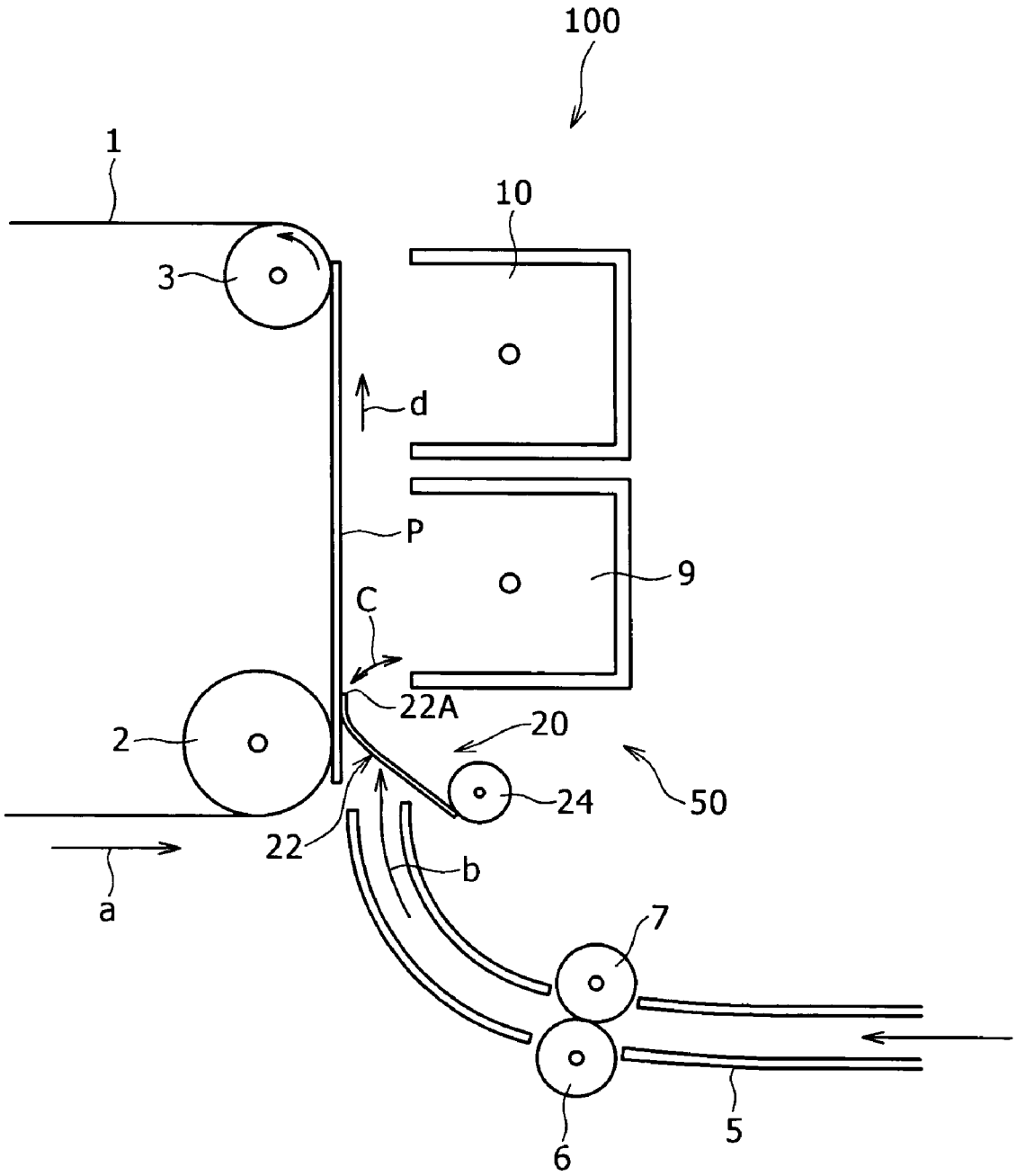
FIG. 2 illustrates the principal portion of the image forming device provided with the transfer device according to the first embodiment, in which the front end of the transfer assisting blade is in a second position abutted against a recording sheet.

However, as shown in FIG. 2, in synchronism with the timing when a controller (not shown) controls the drive mechanism (not shown) to convey the recording sheet P to between the transfer corotron 9 and the photosensitive body 1 (just after a front end of the recording sheet P passes the front end 22A of the transfer assisting blade 22), the transfer assisting blade 22 is turned a predetermined angle counterclockwise, centered on the rotating shaft 24, thereby causing its front end 22A to occupy a second position in which the front end 22A is contacted with the back side of the recording sheet P to press a to-be-image-transferred surface of the recording sheet P against the photosensitive body 1.

That is, with the elastic force of the transfer assisting blade 22 lying in the second position (the state of FIG. 2), the recording sheet P is pressed against and into close contact with the photosensitive body 1.

The recording sheet P as pressed into close contact with the photosensitive body 1 by the transfer assisting blade 22 is charged by corona discharge from the transfer corotron 9, whereby the toner image on the photosensitive body 1 is transferred onto the to-be-image-transferred surface of the recording sheet P.

Just before a rear end of the recording sheet P passes the front end 22A of the transfer assisting blade 22, the controller (not shown) causes the front end 22A of the transfer assisting blade 22 to turn clockwise, thereby releasing the contact of the front end 22A with the recording sheet P.

The recording sheet P with the toner image thus transferred thereto is destaticized by corona discharge from the release corotron 10 and is thereby released from the photosensitive body 1, then is fed to a fixing device (not shown) to fix the toner image.

A description will be given below about the transfer assisting blade 22 of the transfer device 50.

Figure 3:
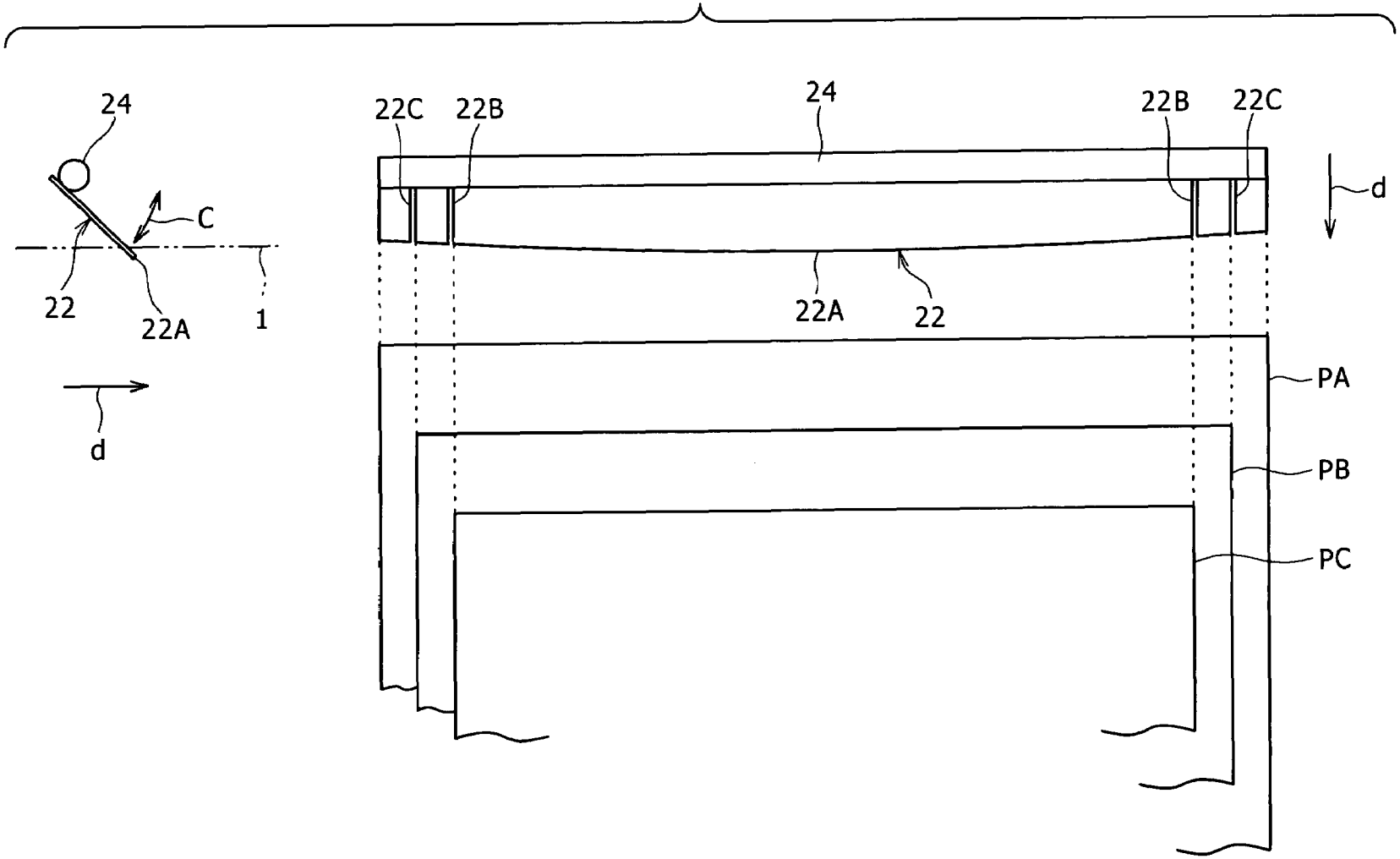
FIG. 3 is a front view as a right-hand view showing the transfer assisting blade in the transfer device according to the first embodiment and also showing a relation between recording sheet sizes and cut-in positions of the transfer assisting blade, and a side view as a left-hand view showing the transfer assisting blade in the transfer device according to the first embodiment.

The transfer assisting blade 22 is constituted by an elastically transformable sheet such as PET and, as shown in FIG. 3, the front end 22A of the transfer assisting blade 22, in other words, a portion of the blade which comes into abutment against the back side of the recording sheet P, is in an arcuate shape expanded centrally in an advancing direction d (see FIG. 2) of the recording sheet P.

The image forming device 100 permits image formation on recording sheets PA, PB and PC of three sheet sizes. In the image forming device 100, the recording sheets PA, PB and PC are urged from both sides in a transverse direction (a direction orthogonal to the advancing direction d) and are registered with the center in the transverse direction as a reference, that is, the so-called "center registering" is adopted. The transfer assisting blade 22 is formed with cut-in portions 22B and 22C in conformity with the sizes of the recording sheets PA, PB and PC. Therefore, no matter which of the recording sheets PA, PB and PC may be conveyed, the adhesion to the photosensitive body 1 is improved.

A description will be given below about the operation of the above embodiment.

As noted above, the abutting portion of the transfer assisting blade 22 for abutment against the back side of the recording sheet P, i.e., the front end 22A of the blade 22, is in a centrally expanded arcuate shape in the advancing direction d of the recording sheet P.

Figure 4:
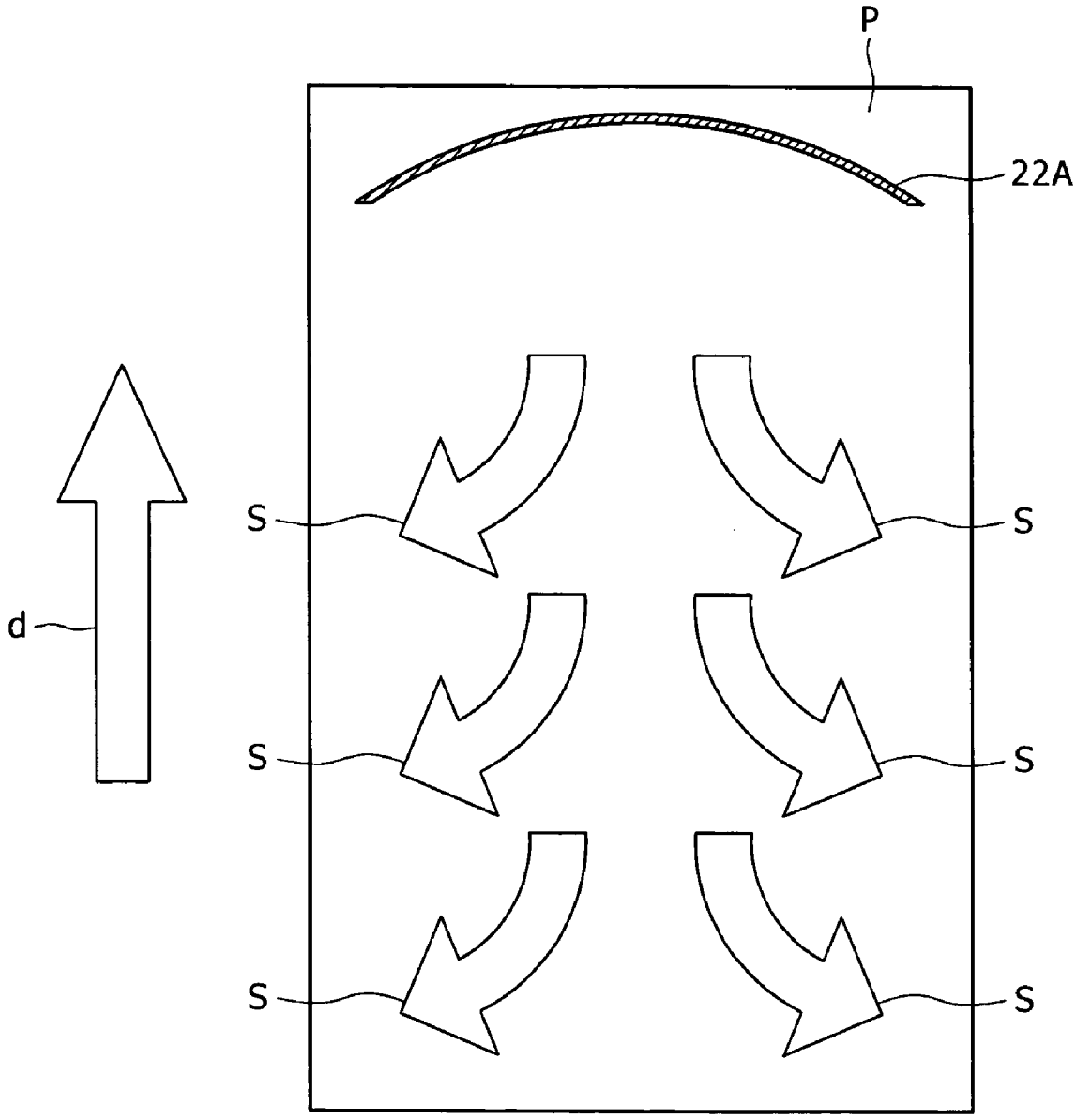
FIG. 4 is an explanatory diagram illustrating in what manner a nip pressure is applied to the recording sheet so as to stroke the sheet by the front end of the transfer assisting blade in the transfer device according to the first embodiment.

Therefore, as shown in FIG. 4, the abutting portion of the transfer assisting blade 22 for abutment against the back side of the recording sheet P is inclined obliquely backward to both sides from the center in the transverse direction. Further, since the length of the transfer assisting blade 22 is the largest at the center, the nip pressure is the highest at the center. Accordingly, as indicated by arrows S in FIGS. 4, 5A and 5B, there arises such a nip pressure as strokes the recording sheet P obliquely backward to both right and left sides from the center.

Figure 5A:
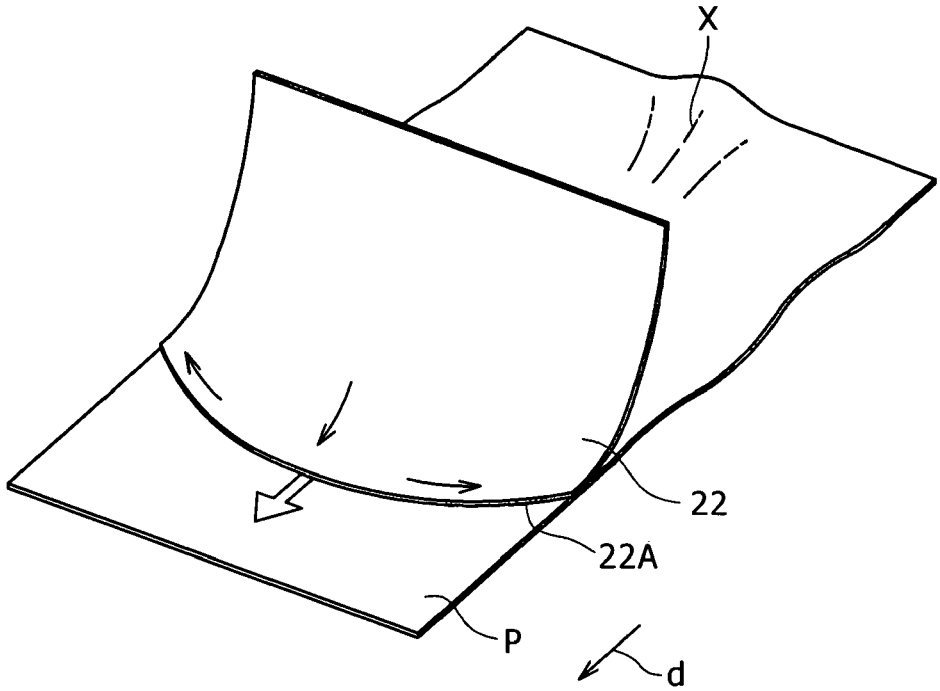
FIGS. 5A and 5B are explanatory diagrams illustrating in what manner the wrinkles of the recording sheet are removed by the transfer assisting blade in the transfer device according to the first embodiment.
Figure 5B:
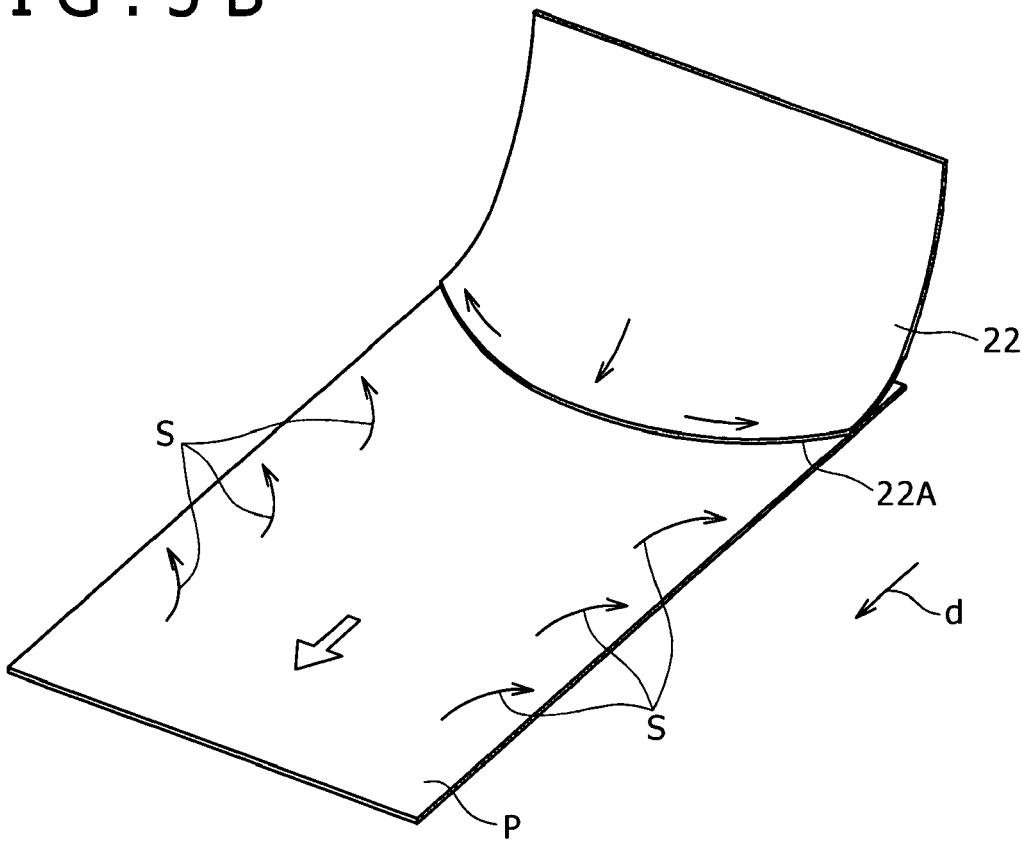

Consequently, even if wrinkles X are formed on the recording sheet P as in FIG. 5A, the wrinkles X are smoothed or shift obliquely backward to both right and left sides as in FIG. 5B. Thus, a gap (air gap) based on wrinkles is not formed between the photosensitive body 1 and the recording sheet P. That is, the recording sheet P and the photosensitive body 1 come into close contact with each other and the toner image on the photosensitive body 1 is transferred in a satisfactory manner onto the recording sheet 1.

The following description is now provided about modifications of the transfer assisting blade 22 in the transfer device 50 according to the first embodiment.

(First Modification)

Figure 6A:
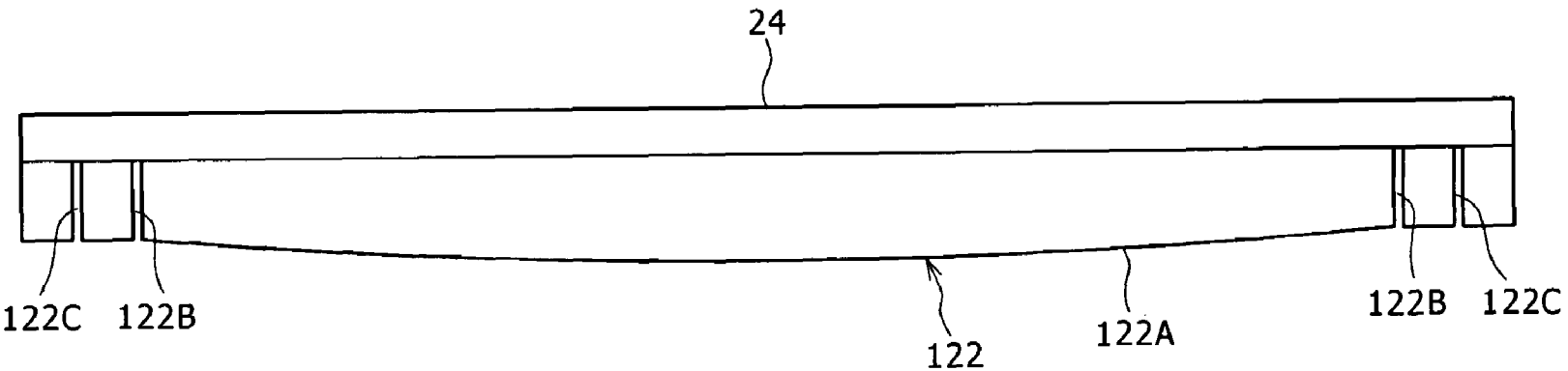
FIGS. 6A and 6B illustrate a first modification and a second modification, respectively, of the transfer assisting blade in the transfer device according to the first embodiment.

As shown in FIG. 6A, a transfer assisting blade 122 includes cut-in portions 122B and 122C, and an arcuately curved portion of a front end 122A (an abutting portion for abutment against the photosensitive body 1). The front end 122A of the transfer assisting blade 122 is present only between cut-in portions 122B. Therefore, processing is easier in comparison with the transfer assisting blade 22 shown in FIG. 3.

Figure 6B:
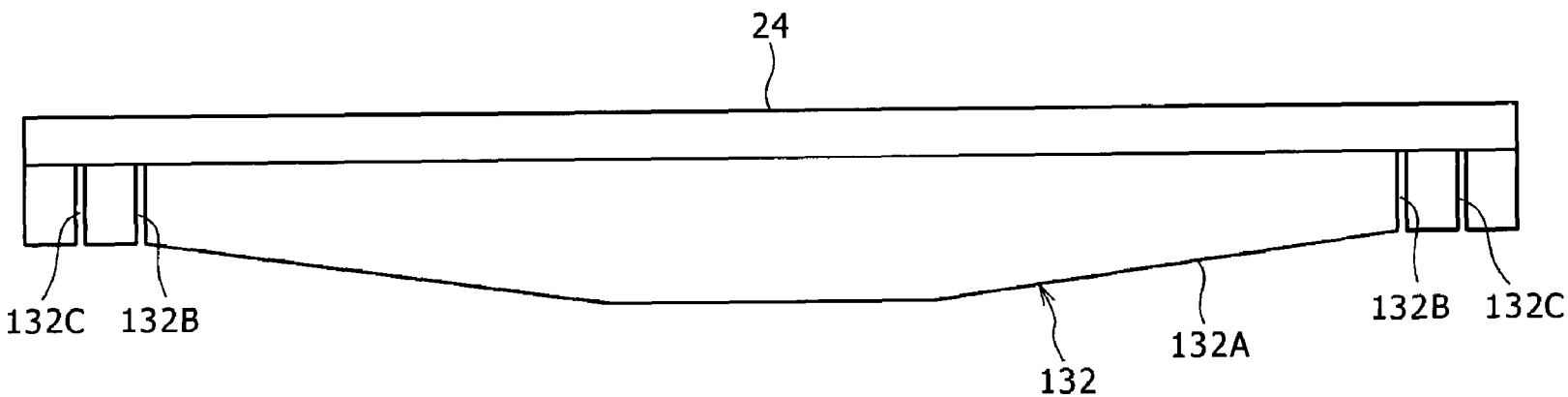

As shown in FIG. 6B, a transfer assisting blade 132 includes cut-in portions 132B and 132C, and an arcuately curved portion of a front end 132A (an abutting portion for abutment against the photosensitive body 1). The front end 132A of the transfer assisting blade 132 is present only between cut-in portions 132B. Further, the curved portion is formed by plural straight lines. That is, the curved portion is generally polygonal in shape.

According to this construction, processing is easier because the transfer assisting blade 132 can be formed by only rectilinear machining.

In the case of the transfer assisting blade 22 (see FIG. 3) used in the first embodiment, the front end 22A is wholly constituted by a curved line and therefore wrinkles of the recording sheet P are removed in such a manner as strokes the sheet most smoothly. However, any of the transfer assisting blades 22, 122 and 132 in the first embodiment, the first modification and the second modification, respectively, may be selected taking into account the balance between the processing cost and the performance required actually.

(Third Modification)

Figure 7:
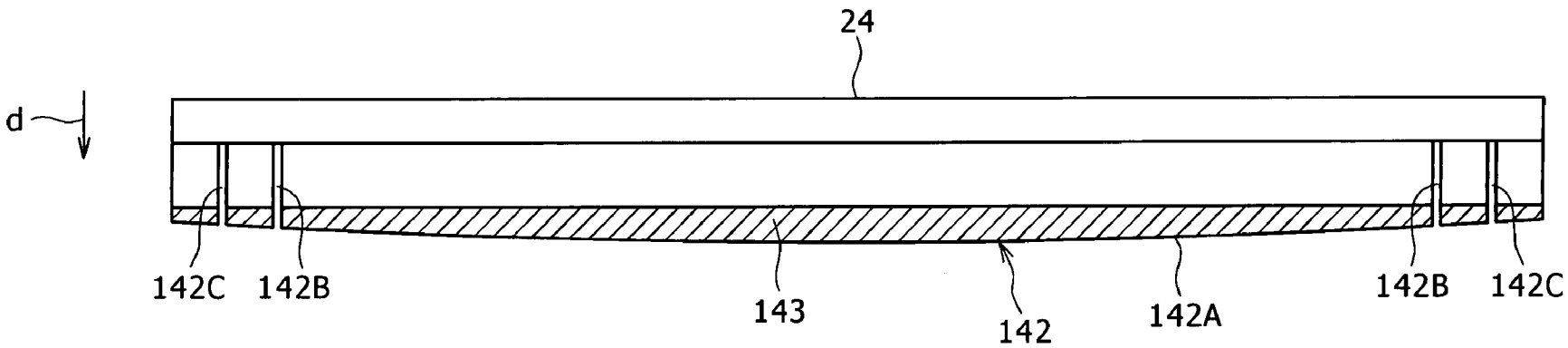
FIG. 7 illustrates a third modification of the transfer assisting blade in the transfer device according to the first embodiment.

FIG. 7 shows a transfer assisting blade 142 that includes cut-in portions 142B and 142C, and a front end 142A. A low resistance portion 143 for decreasing a sliding resistance with respect to the recording sheet P is provided at the front end 142A (an abutting portion for abutment against the photosensitive body 1) of a transfer assisting blade 142 and in the vicinity thereof. The low resistance portion 143 may be a low resistance film such as Teflon (a registered trademark) coating or a Teflon (a registered trademark) tape may be affixed to the front end 142A and the vicinity thereof.

Since the sliding resistance with respect to the recording sheet P is decreased by the low resistance portion 143, not only the recording sheet P is conveyed smoothly but also the back side of the recording sheet P becomes difficult to be damaged.

Figure 8A:
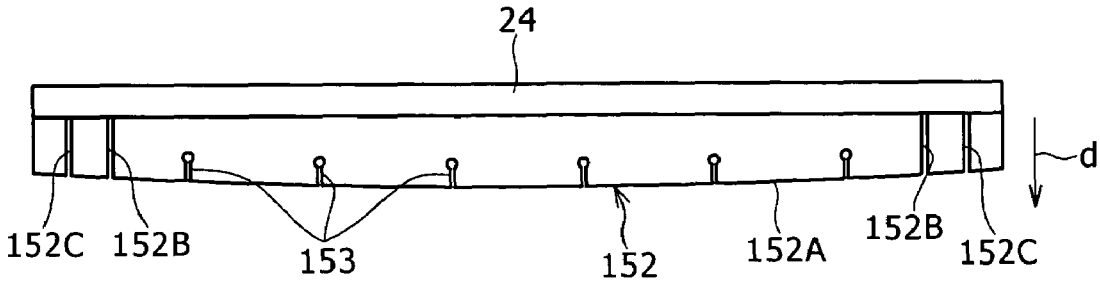
FIGS. 8A, 8B and 8C illustrate a fourth modification, a fifth modification and a sixth modification, respectively, of the transfer assisting blade in the transfer device according to the first embodiment.

FIG. 8A shows a transfer assisting blade 152 that includes cut-in portions 152B and 152C, and a front end 152A. Plural slits 153 are formed in the same direction as the sheet advancing direction d from the front end 152A (an abutting portion for abutment against the photosensitive body 1) of the transfer assisting blade 152. With the slits 153, the front end 152A (an abutting portion for abutment against the photosensitive body 1) of the transfer assisting blade 152 deflects flexibly, so that the adhesion between the recording sheet P and the photosensitive body 1 is further improved.

Also in each of the following fifth to eighth modifications, as in the fourth modification, a front end (an abutting portion for abutment against the photosensitive body 1) of a transfer assisting blade is deflected flexibly to further improve the adhesion between the recording sheet P and the photosensitive body 1, and therefore the description of operation will be omitted.

(Fifth Modification)

Figure 8B:
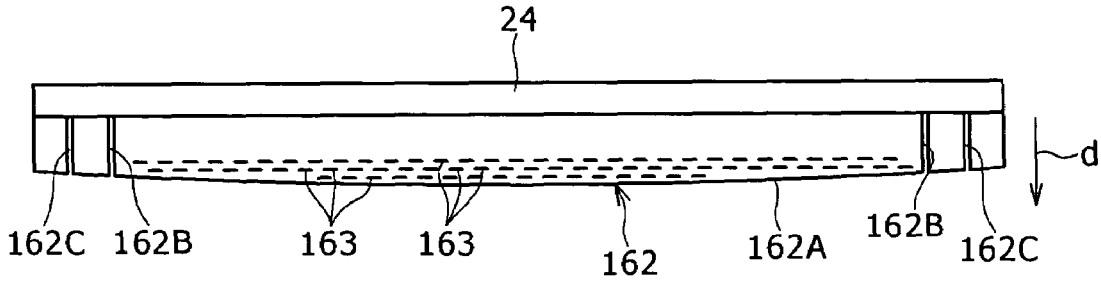

FIG. 8B shows a transfer assisting blade 162 that includes cut-in portions 162B and 162C, and a front end 162A. Plural perforated lines 163 (intermittent cut-in lines) are formed in a direction orthogonal to the sheet advancing direction d near the front end 162A (an abutting portion for abutment against the photosensitive body 1) of the transfer assisting blade 162.

Figure 8C:
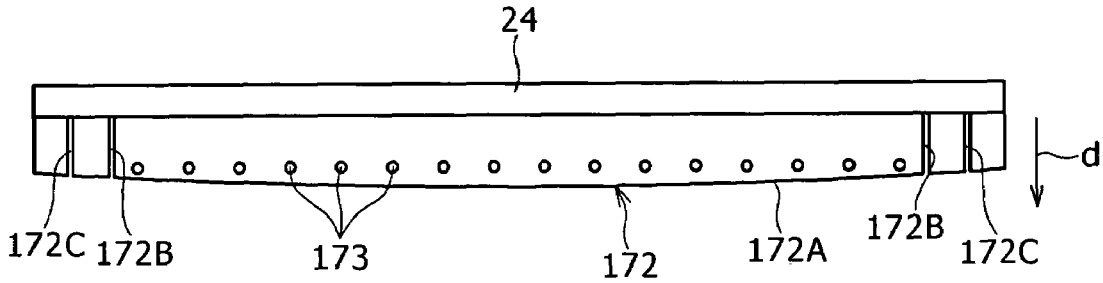

FIG. 8C shows a transfer assisting blade 172 that includes cut-in portions 172B and 172C, and a front end 172A. Plural circular holes 173 are formed near the front end 172A (an abutting portion for abutment against the photosensitive body 1) of the transfer assisting blade 172.

Figure 9A:
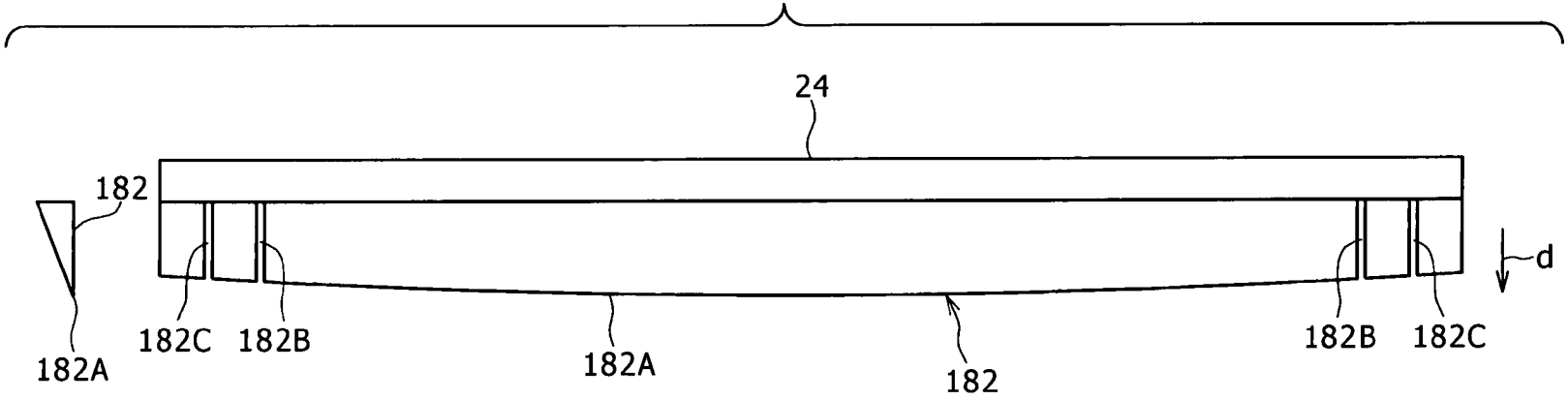
FIG. 9A is a front view as a right-hand view illustrating a seventh modification and a side view as a left-hand view of the seventh modification and FIG. 9B is a front view as a right-hand view illustrating an eighth modification and a side view as a left-hand view of the eighth modification, of the transfer assisting blade in the transfer device according to the first embodiment.

As shown in FIG. 9A, a transfer assisting blade 182 includes cut-in portions 182B and 182C and has a tapered section (see the left-hand view) wherein the closer to a front end 182A (an abutting portion for abutment against the photosensitive body 1) of the transfer assisting blade 182, the smaller the thickness). Therefore, the closer to the front end 182A (an abutting portion for abutment against the photosensitive body 1) of the transfer assisting blade 182, the weaker the elastic force and the more flexible the deflection.

Figure 9B:
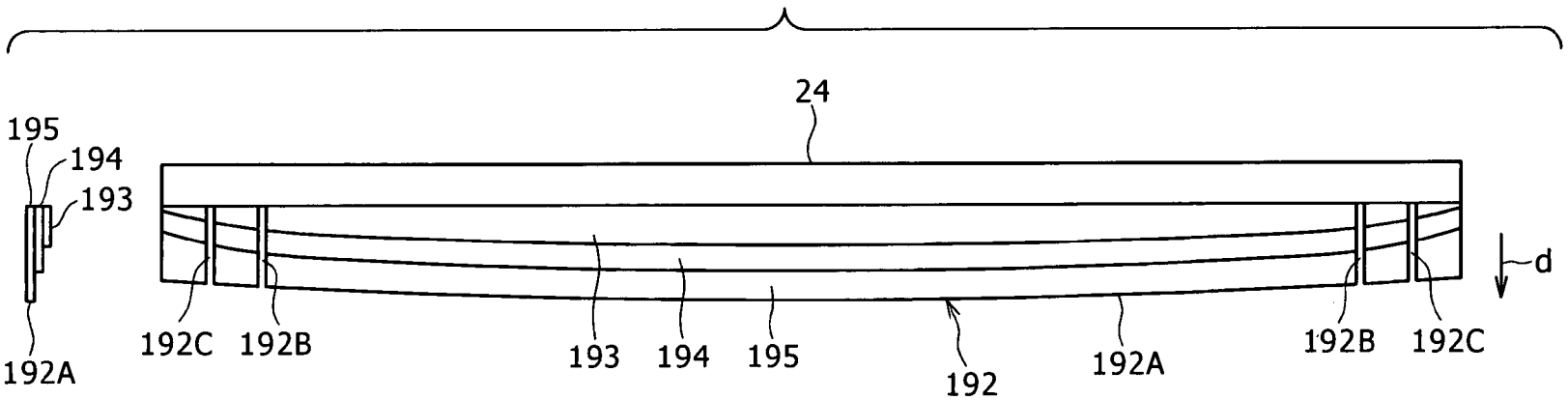

As shown in FIG. 9B, a transfer assisting blade 192 includes cut-in portions 192B and 192C, and is formed by joining plural sheets 193, 194 and 195 of different lengths, and the closer to a front end 192A (an abutting portion for abutment against the photosensitive body 1), the smaller the number (thickness) of overlapping sheets. Therefore, the closer to the front end 192A (an abutting portion against the photosensitive body 1) of the transfer assisting blade 192, the weaker the elastic force and the more flexible the deflection.

Next, a description will be given below about a transfer device 52 according to a second embodiment of the present invention. The same members as in the first embodiment are identified by the same reference numerals as in the first embodiment and tautological explanations will be omitted.

Figure 10:
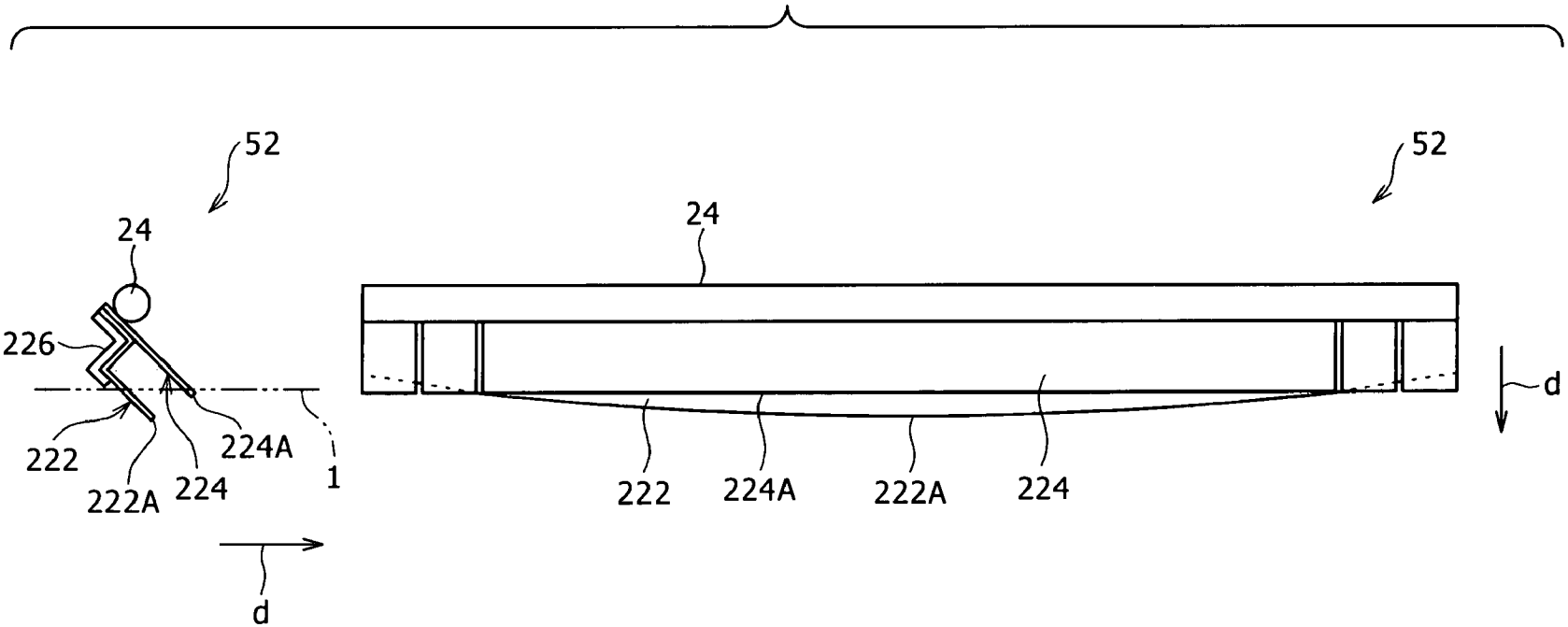
FIG. 10 is a front view as a right-hand view illustrating a transfer assisting blade in a transfer device according to a second embodiment of the present invention and a side view as a left-hand view thereof.

As shown in FIG. 10, a first transfer assisting blade 222 and a second transfer assisting blade 224 are fixed to the rotating shaft 24. The first transfer assisting blade 222 is fixed to the rotating shaft 24 through a stay 226. The first and second transfer assisting blades 222, 224 are spaced from each other in the sheet advancing direction d.

Therefore, at the second position (see FIG. 2) as the sheet-blade contact position, first, a front end 222A of the first transfer assisting blade 222 located on an upstream side comes into abutment against the recording sheet P and presses the sheet against the photosensitive body 1, then a front end 224A of the second transfer assisting blade 224 located on a downstream side comes into abutment against the recording sheet P and presses the sheet against the photosensitive body 1.

Figure 16A:
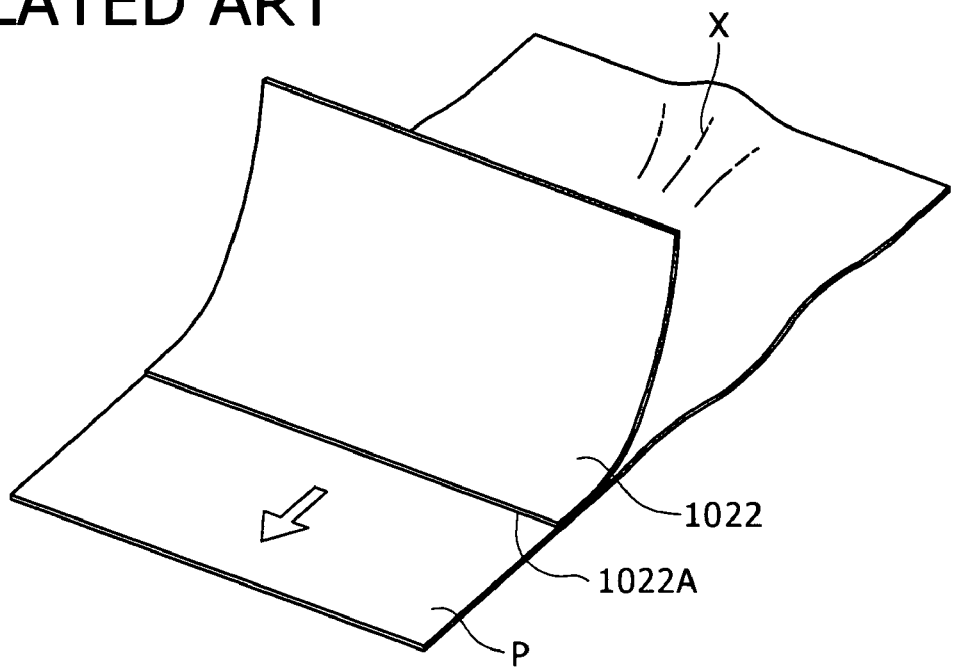
FIG. 16A RELATED ART
FIGS. 16A and 16B are explanatory diagrams illustrating a state in which wrinkles of a recording sheet are not removed by a transfer assisting blade in a conventional transfer device.
Figure 16B:
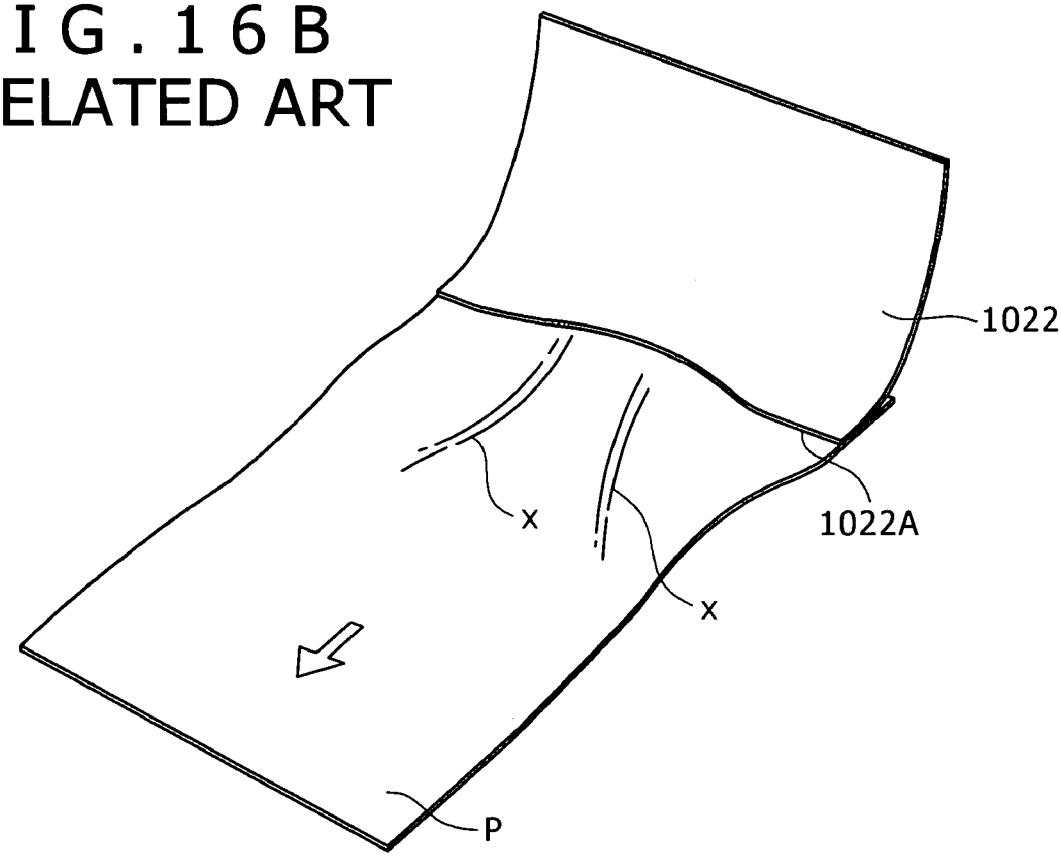
FIG. 16B RELATED ART

Like the front end 22A of the transfer assisting blade 22 in the first embodiment, the front end 222A of the first transfer assisting blade 222 is in an arcuate shape (see FIG. 3). The front end 224A of the second transfer assisting blade 224 is in the shape of a straight line orthogonal to the sheet advancing direction d, which shape is the same as that of the conventional transfer assisting blade 1022 (see FIGS. 16A and 16B).

Next, the following description is provided about the operation of this second embodiment.

First, the front end 222A of the first transfer assisting blade 222 located on the upstream side comes into abutment against the recording sheet P and presses against the photosensitive body 1 to smooth wrinkles. Further, the second transfer assisting blade 224 located on the downstream side comes into abutment against the recording sheet P to press the recording sheet P uniformly against and into close contact with the photosensitive body 1.

Thus, the first transfer assisting blade 222 located on the upstream side mainly aims at smoothing wrinkles of the recording sheet P, while the second transfer assisting blade 224 located on the downstream side mainly aims at pressing the recording sheet P uniformly against the photosensitive body 1. That is, functions are shared.

Accordingly, the arcuate shape of the front end 222A of the first transfer assisting blade 222 can be made a shape specialized in smoothing wrinkles of the recording sheet P. Further, it is possible to handle various types of recording sheets (e.g., recording sheets P different in thickness or stiffness) by combining the first and second transfer assisting blades 222, 224.

Although the transfer assisting blade used in the above second embodiment is composed of the two, first and second transfer assisting blades 222, 224, it may be composed of three or more transfer assisting blades.

A description will now be given about a transfer device 54 according to a third embodiment of the present invention. The same members as in the first and second embodiments are identified by the same reference numerals as in those embodiments and tautological explanations will be omitted.

Figure 11A:
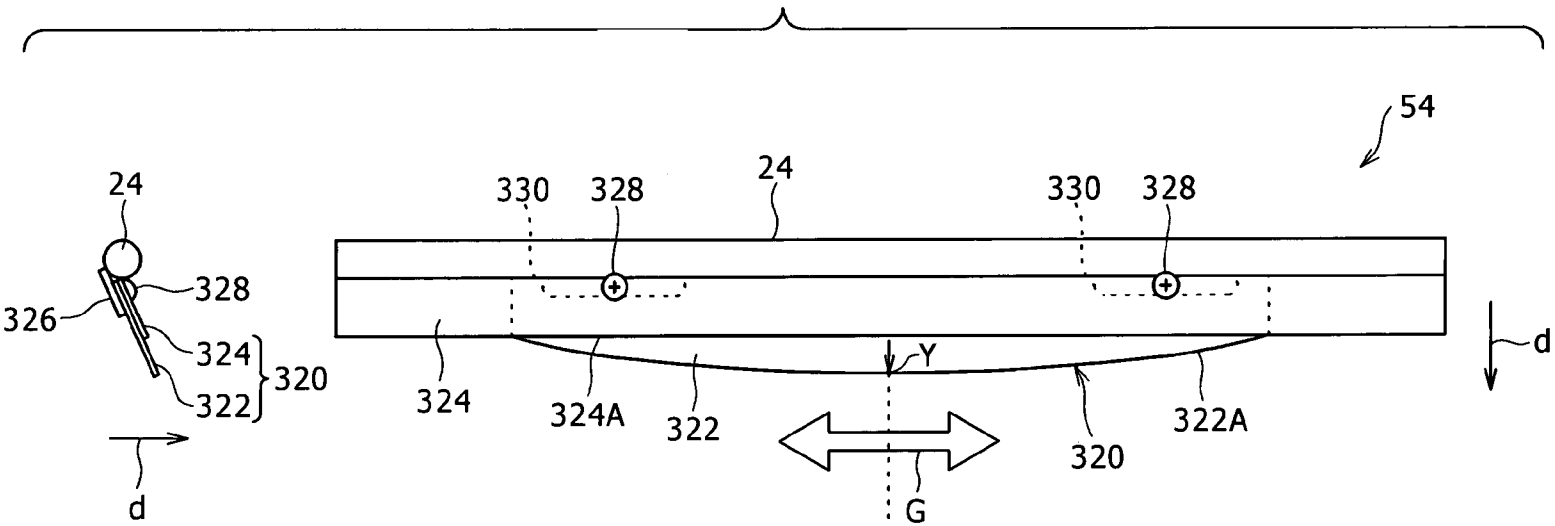
FIG. 11A is a front view as a right-hand view and a side view as a left-hand view both illustrating a transfer assisting blade in a transfer device according to a third embodiment of the present invention and FIG. 11B is a front view showing a shifted state of a vertex portion of the blade.

As shown in FIG. 11A, a stay 326 is fixed to the rotating shaft 24 and a transfer assisting blade 320 is fixed to the stay 326. The transfer assisting blade 320 is composed of a first blade 324 which is in an elongated quadrangular shape and a second blade 322 having an arcuate front end 322A which blades 322, 324 are superimposed one on the other.

The arcuate portion of the second blade 322 projects in the sheet advancing direction d from a front end 324A of the first blade 324, but the width thereof orthogonal to the direction d is narrow.

The second blade 322 has elongated holes 330 formed in a direction G orthogonal to the sheet advancing direction d and machine screws 328 are inserted through the elongated holes 330 to screw (fix) the second blade 322 to the stay 326. When the machine screws 328 are loosened, it becomes possible for the second blade 322 to move in the direction G orthogonal to the sheet advancing direction d.

Next, the operation of this third embodiment will be described below.

The second blade 322 is movable in the direction G orthogonal to the sheet advancing direction d, that is, a vertex portion Y of the arcuate front end 322A is movable in the direction G orthogonal to the sheet advancing direction d.

Figure 11B:
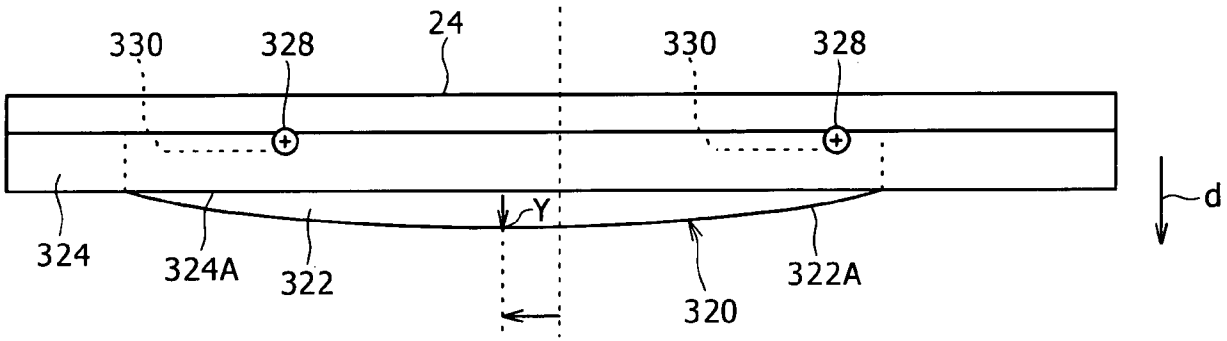

Therefore, for example by changing the position of the vertex portion Y as shown in FIG. 11B, the wrinkle smoothing method can be changed so as to be different between the right and left sides. Thus, the position of the vertex portion Y can be adjusted to an optimal position according to variations in the conveyance path and according to easiness of wrinkling in the transverse direction (the direction G orthogonal to the sheet advancing direction d).

In the image forming device 100, the recording sheet P is registered in accordance with the center registering method (see FIG. 3), but in the case of the so-called "side registering" wherein the recording sheet P is urged from one side in the transverse direction and the position thereof is registered with the other edge as a reference, the position of the vertex portion Y can be adjusted to an optimal position in accordance with the sheet size.

Next, a description will be given below about a transfer device 56 according to a fourth embodiment of the present invention. The same members as in the first to third embodiments are identified by the same reference numerals as in those embodiments, and tautological explanations will be omitted.

Figure 12A:
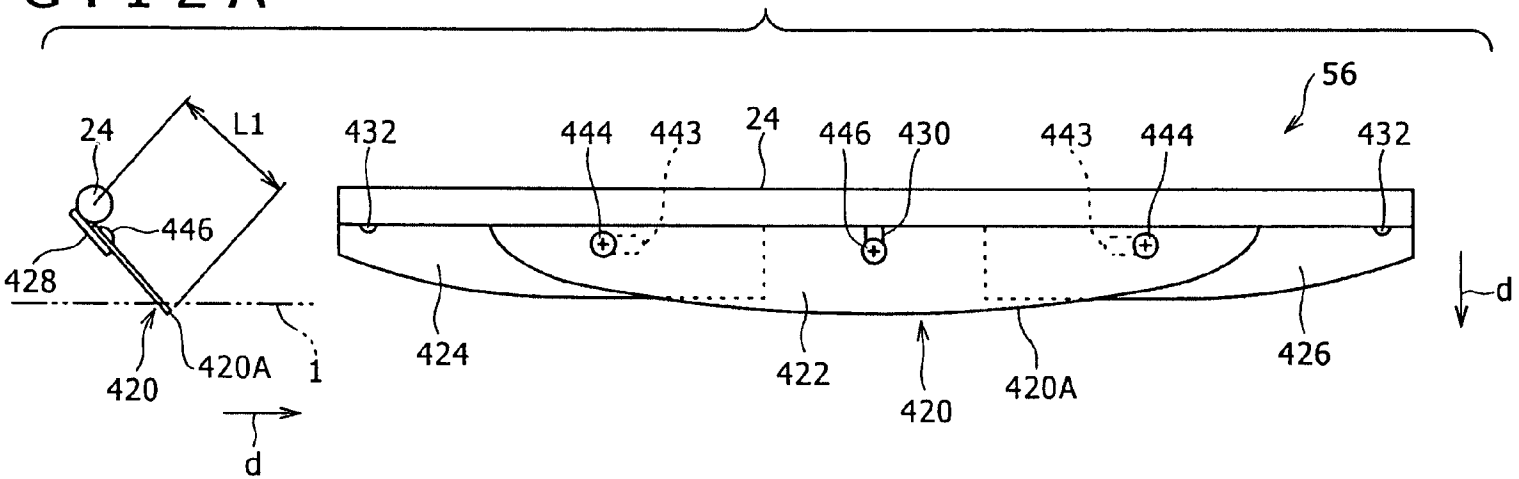
FIG. 12A is a front view as a right-hand view and a side view as a left-hand view both illustrating a transfer assisting blade in a transfer device according to a fourth embodiment of the present invention and FIG. 12B is a front view as a right-hand view showing a state in which the curvature is set steep and the length is set large and a side view as a left-hand view in the transfer assisting blade.

As shown in FIG. 12A, a stay 428 is fixed to the rotating shaft 24 and a transfer assisting blade 420 is fixed to the stay 428. The transfer assisting blade 420 is composed of three blades each having an arcuate front end, the three blades being a first blade 422, a second blade 424 and a third blade 426 which are arranged in an overlapping and juxtaposed fashion in the transverse direction (a direction orthogonal to the sheet advancing direction d).

The second blade 424 and the third blade 426 are adapted to pivot respectively about shafts 432 formed on the stay 428 and are connected to the first blade 422 through shafts 444. A machine screw 446 is inserted into an elongated hole 430 which is long in the sheet advancing direction d to screw (fix) the first blade 422 to the stay 428.

Figure 12B:
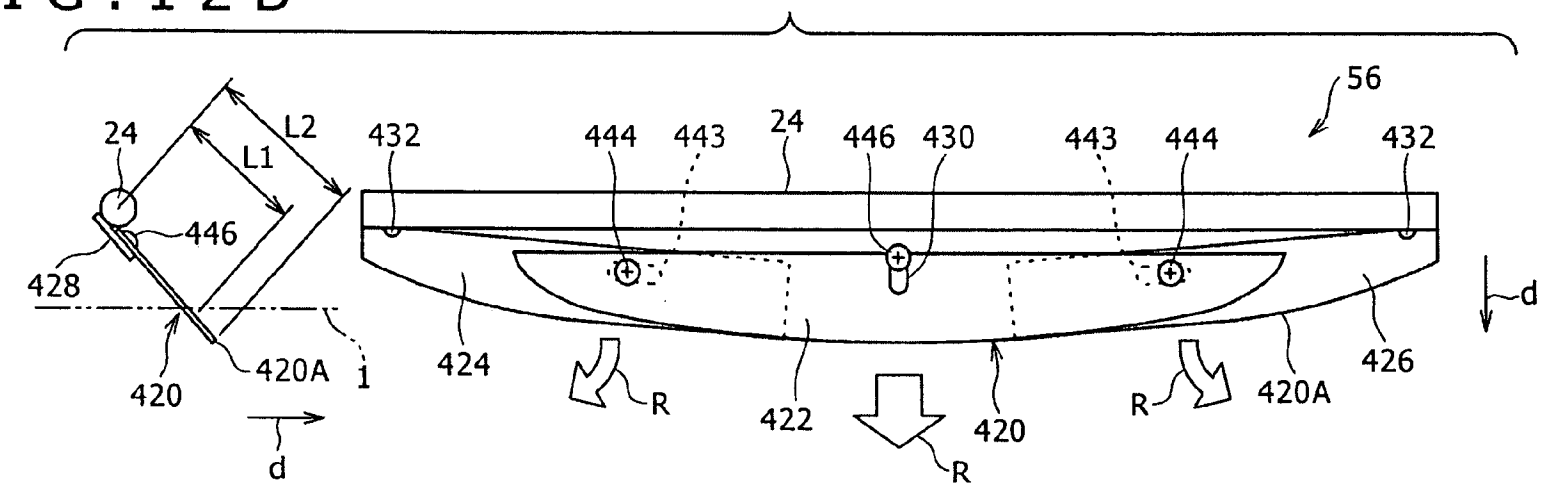

Since the transfer assisting blade 420 is constructed as above, as shown in FIG. 12B, when the machine screw 446 is loosened and the first blade 422 is moved in the sheet advancing direction d, the positions of the shafts 444 also shift in the direction d and the second and third blades 424, 426 pivot about the shafts 432. (See arrows R in FIG. 12B.)

In the second and third blades 424, 426, there are formed elongated holes 443 of such a shape as does not obstruct the movement of the shafts 444 when the blades 424, 426 pivot about the shafts 432.

Thus, in the state of FIG. 12A, the curvature of the arcuate shape of a front end 420A of the transfer assisting blade 420 is gentle and the length L1 (see the left-hand view) of the transfer assisting blade 420 is short and its pressing force against the recording sheet P is weak.

On the other hand, in the state of FIG. 12B, the curvature of the arcuate shape of the front end 420A is steep and the length L2 (see the left-hand view) of the transfer assisting blade 420 is large, so that the pressing force against the recording sheet P is strong.

Thus, the curvature of the front end 420A and the pressing force against the recording sheet P can be adjusted by changing the shape of the front end 420A of the transfer assisting blade 420.

The following description is now provided about the operation of this fourth embodiment.

In the transfer device 56, as described above, the curvature of the front end 420A and the pressing force against the recording sheet P can be adjusted by changing the shape of the front end 420A of the transfer assisting blade 420. (See FIGS. 12A and 12B.)

Thus, an optical shape can be obtained in accordance with the type of the recording sheet P. For example, in the case of a thick recording sheet P or a recording sheet P of strong stiffness, the sheet is difficult to be wrinkled and therefore the shape of FIG. 12A is adopted, while in the case of a thin recording sheet P or a recording sheet P of weak stiffness, the shape of FIG. 12B is adopted.

An optimal shape can also be obtained in accordance with the density of a toner image to be transferred which is formed on the photosensitive body 1. For example, in the case of a toner image (e.g., solid black) high in percent printing, the amount of toner interposed between the photosensitive body 1 and the recording sheet P is large and an electrostatic attractive force for the photosensitive body 1 decreases, so that wrinkles are easy to be removed. Therefore, in the case of printing such an image continuously, the shape of FIG. 12A is selected. Conversely, in the case of a toner image (e.g., an image made up of only characters or lines) low in percent printing, the amount of toner interposed between the photosensitive body 1 and the recording sheet P is small and the electrostatic attractive force for the photosensitive body 1 increases, so that wrinkles are difficult to be removed. Therefore, in the case of printing such an image continuously, the shape of FIG. 12B is selected.

Next, a description will be given about a transfer device 58 according to a fifth embodiment of the present invention. The same members as in the first to fourth embodiments are identified by the same reference numerals as in those embodiments and tautological explanations will be omitted.

Figure 13:
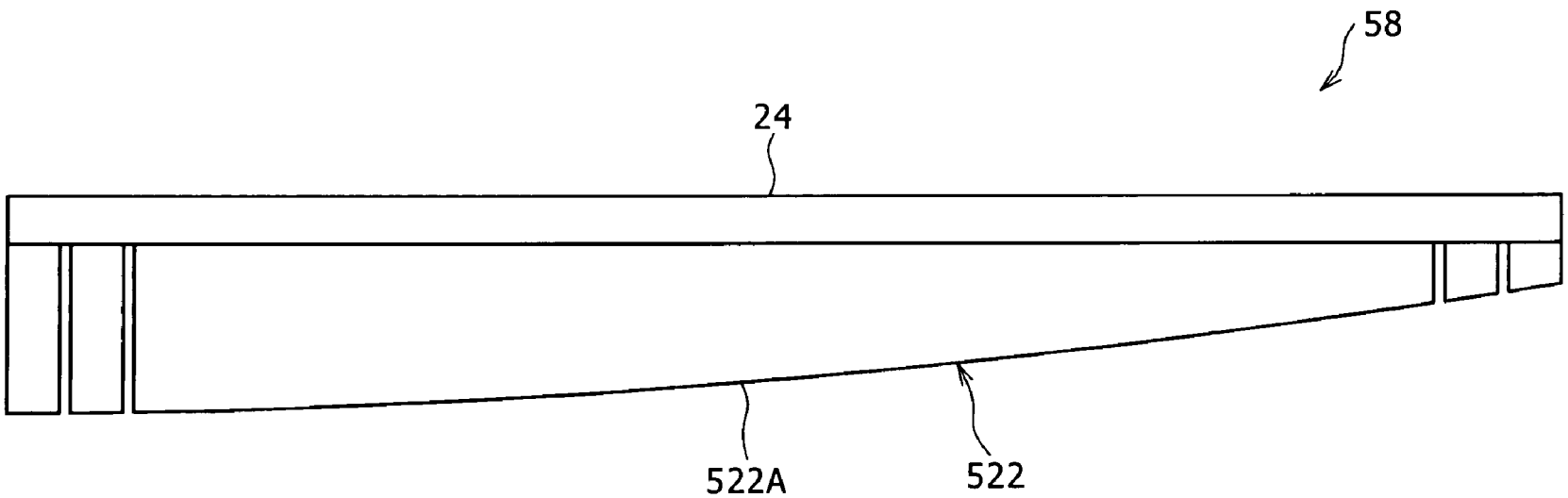
FIG. 13 illustrates a transfer assisting blade in a transfer device according to a fifth embodiment of the present invention.

As shown in FIG. 13, a transfer assisting blade 522 is fixed to the rotating shaft 24. An abutting portion of the transfer assisting blade 522 for abutment against the back side of the recording sheet P, i.e., a front end 522A of the blade 522, is inclined from one end side toward the other end side in the transverse direction relative to the advancing direction d of the recording sheet P. The front end 522A is not rectilinear but gently curved as a whole.

Next, the operation of this fifth embodiment will be described below.

As noted above, the front end 522A of the transfer assisting blade 522 is inclined from one end side toward the opposite end side in the transverse direction relative to the advancing direction d of the recording sheet P.

Figure 14:
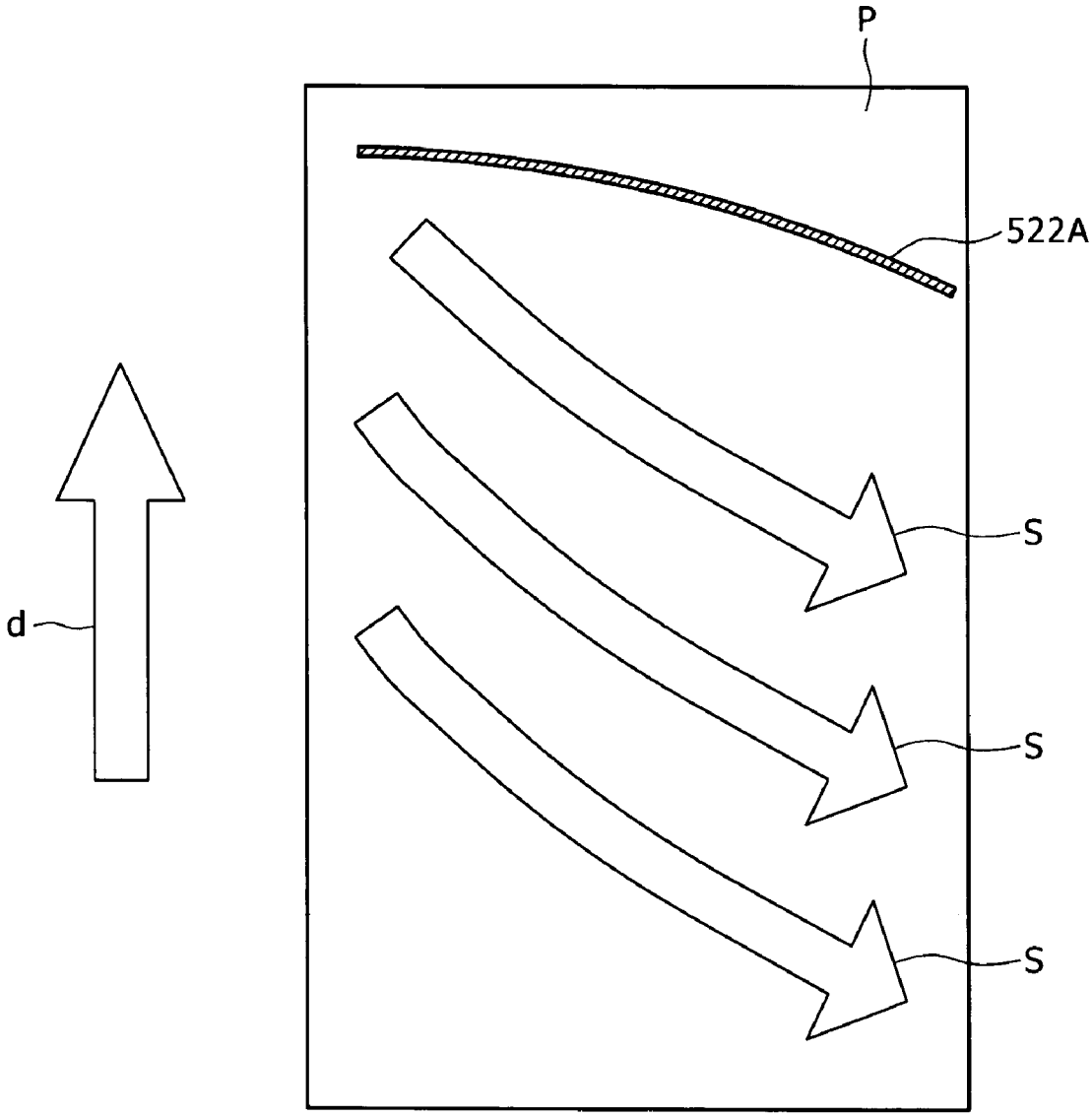
FIG. 14 is an explanatory diagram illustrating in what manner a nip pressure is applied to a recording sheet so as to stroke the sheet by a front end of the transfer assisting blade in the transfer device according to the fifth embodiment.

Therefore, as shown in FIG. 14, the position of abutment of the transfer assisting blade 522 against the back side of the recording sheet P is inclined obliquely backward from one end side toward the opposite end side. In addition, since the transfer assisting blade 522 is longer on the one end side, the nip pressure is higher on the one end side. Consequently, as indicated by arrows S in FIGS. 14 and 15A and 15B, a nip pressure is applied to the recording sheet P so as to stroke the sheet from the one end side toward the other end side.

Figure 15A:
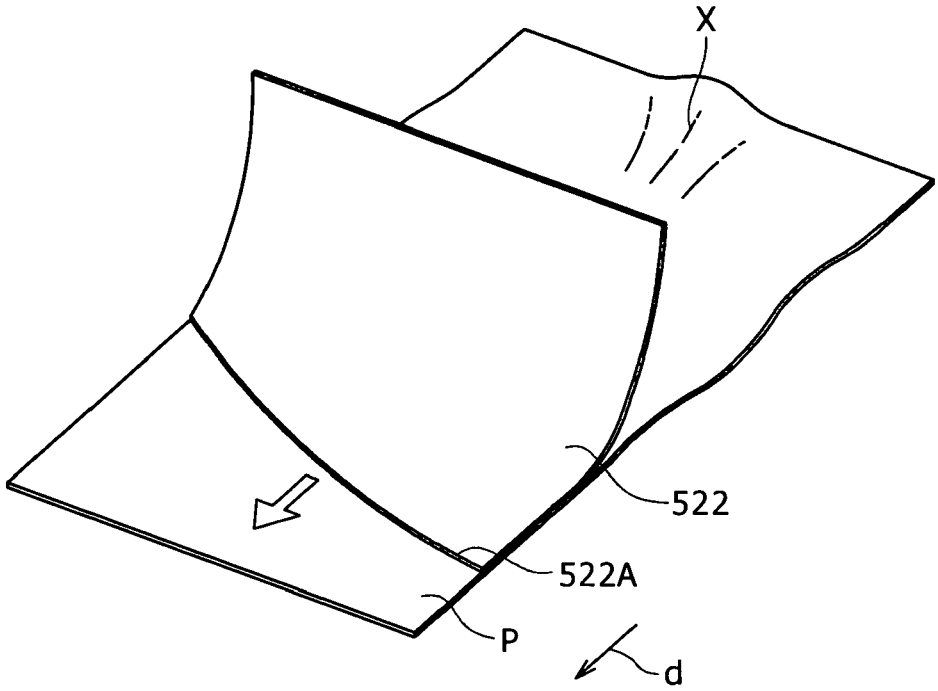
FIGS. 15A and 15B are explanatory diagrams illustrating in what manner wrinkles of the recording sheet are removed by the transfer assisting blade in the transfer device according to the fifth embodiment.
Figure 15B:
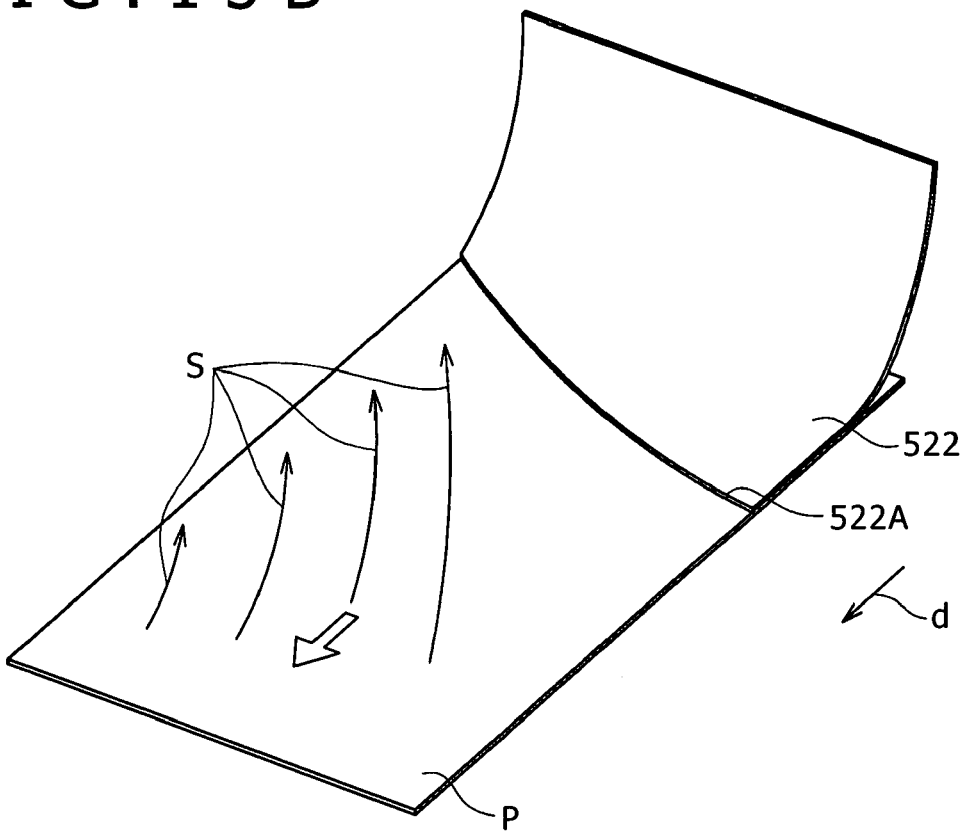

Therefore, even if wrinkles X are formed on the recording sheet P as in FIG. 15A, the wrinkles X are smoothed as in FIG. 15B or shift toward the other end side, posing no problem. Thus, a space (air gap) is not created between the photosensitive body 1 and the recording sheet P. That is, the recording sheet P and the photosensitive body 1 come into close contact with each other and the toner image on the photosensitive body 1 is transferred onto the recording sheet P in a satisfactory manner.

The present invention is not limited to the above embodiments.

For example, although the transfer assisting blades used in the above embodiments are elastically transformable blades, no limitation is made thereto. Even blades having little elasticity will do. Even in the case of a transfer assisting blade having little elasticity, since the photosensitive body 1 is belt-like, the belt-like photosensitive body 1 deflects and induces an appropriate pressing force against the recording sheet P.

The image carrier is not limited to the belt-like photosensitive body 1. For example, a drum-like photosensitive body will do, or even a belt- or drum-like intermediate transfer body will do.

As described above, according to an aspect of the present invention, there is provided a transfer device for transferring a toner image formed on an image carrier onto a recording sheet, the transfer device including a transfer assisting blade adapted to abut the recording sheet and press the recording sheet against the image carrier, the transfer assisting blade having a slant formed in a transverse direction of the blade at a front end of the blade which end is for abutment against the recording sheet, the slant having an angle relative to an advancing direction of the recording sheet.

In the transfer device according to the above aspect of the invention, the transfer assisting blade comes into abutment against the recording sheet to press the recording sheet into close contact with the image carrier and in this state the toner image formed on the image carrier is transferred onto the recording sheet.

Since the transfer assisting blade has a slant in its transverse direction at its front end for abutment against the recording sheet, the slant having an angle relative to the advancing direction of the recording sheet, a force acting to stroke the recording sheet is applied to the recording sheet along the slant formed at the front end of the blade. Therefore, for example, strains such as wrinkles, if any, on the recording sheet are removed, whereby the adhesion between the image carrier and the recording sheet is further improved.

According to another aspect of the present invention, there is provided a transfer device for transferring a toner image formed on an image carrier onto a recording sheet, the transfer device including plural transfer assisting blades adapted to abut the recording sheet and press the recording sheet against the image carrier, the transfer assisting blades being disposed spacedly in an advancing direction of the recording sheet, at least one of the transfer assisting blades having a slant formed in a transverse direction of the blade at a front end of the blade which end is for abutment against the recording sheet, the slant having an angle relative to the advancing direction of the recording sheet.

In the transfer device according to the above aspect of the invention, the plural transfer assisting blades come into abutment against the recording sheet continuously to press the recording sheet against and into close contact with the image carrier and in this state the toner image formed on the image carrier is transferred onto the recording sheet.

Since at least one of the plural transfer assisting blades has a slant in the transverse direction of the blade at the front end of the blade which end is for abutment against the recording sheet, the slant having an angle relative to the advancing direction of the sheet, a force acting to stroke the recording sheet is exerted on the recording sheet along the slant formed at the front end of the blade. Therefore, for example, strains such as wrinkles, if any, on the recording sheet are removed, whereby the adhesion between the image carrier and the recording sheet is further improved.

Moreover, by providing two types of transfer assisting blades and sharing functions, one blade having a slant and aiming mainly at removing strains such as wrinkles on the recording sheet and the other blade not having a slant and aiming mainly at bringing the recording sheet into uniform and close contact with the image carrier, it is possible to further improve the adhesion between the image carrier and the recording sheet.

According to another aspect of the present invention, there may be provided a transfer device wherein the front end of the transfer assisting blade(s) is inclined from one end portion orthogonal to the advancing direction of the recording sheet toward an opposite end portion.

In the transfer device according to the above aspect of the invention, since the front end of the transfer assisting blade(s) is inclined from one end portion orthogonal to the advancing direction of the recording sheet toward an opposite end portion, a force acting to stroke the recording sheet is exerted on the recording sheet from the one end portion toward the opposite end portion. Therefore, for example, strains such as wrinkles, if any, on the recording sheet are removed, whereby the adhesion between the image carrier and the recording sheet is further improved.

According to another aspect of the present invention, there may be provided a transfer device wherein the front end of the transfer assisting blade(s) is expanded centrally in the advancing direction of the recording sheet.

In the transfer device according to the above aspect of the invention, since the front end of the transfer assisting blade(s) is centrally expanded in the advancing direction of the recording sheet, a force acting to stroke the recording sheet is exerted on the sheet from the center toward both end portions. Therefore, for example, strains such as wrinkles, if any, on the recording sheet are removed, whereby the adhesion between the image carrier and the recording sheet is further improved.

According to another aspect of the present invention, there may be provided a transfer device wherein the transfer assisting blade(s) is movable in a direction orthogonal to the advancing direction of the recording sheet.

In the transfer device according to the above aspect of the invention, by moving the transfer assisting blade(s) in a direction orthogonal to the advancing direction of the recording sheet, an expanded vertex portion moves in the direction orthogonal to the sheet advancing direction. Therefore, the position of the transfer assisting blade(s) can be adjusted, for example, to an optimal position matching the size of the recording sheet.

According to another aspect of the present invention, there may be provided a transfer device wherein the shape of the front end of the transfer assisting blade(s) is constituted by a curved line.

In the transfer device according to the above aspect of the invention, since the shape of the front end of the transfer assisting blade(s) is constituted by a curved line, a force acting to stroke the recording sheet is exerted smoothly on the sheet, whereby the adhesion between the image carrier and the recording sheet is further improved.

According to another aspect of the present invention, there may be provided a transfer device wherein the shape of the front end of the transfer assisting blade(s) is constituted by a straight line.

In the transfer device according to the above aspect of the invention, since the shape of the front end of the transfer assisting blade(s) is constituted by a straight line, the processing of the blade front end is easy.

According to another aspect of the present invention, there may be provided a transfer device wherein the shape of the front end of the transfer assisting blade(s) is constituted by a combination of both curved and straight lines.

In the transfer device according to the above aspect of the invention, since the shape of the front end of the transfer assisting blade(s) is constituted by both curved and straight lines, the curved line portion smoothes the sheet stroking force and the straight line portion permits easy processing. Thus, the transfer assisting blade(s) is balanced well in both processability and adhesion.

According to another aspect of the present invention, there may be provided a transfer device wherein the shape of the front end of the transfer assisting blade(s) can be transformed.

In the transfer device according to the above aspect of the invention, the shape of the front end of the transfer assisting blade(s) can be changed to an optimal shape matching the type of the recording sheet for example.

According to another aspect of the present invention, there may be provided a transfer device wherein the transfer assisting blade(s) includes plural overlapped blades arranged in a direction orthogonal to the advancing direction of the recording sheet, the positions of the plural blades being shifted relatively and front ends of the plural blades being transformable.

In the transfer assisting blade according to the above aspect of the invention, the positions of the plural blades are shifted relatively and the shape of their front ends can be changed to an optimal shape matching the type of the recording sheet for example.

According to another aspect of the present invention, there may be provided a transfer device wherein the front end of the transfer assisting blade(s) moves between a first position spaced away from the image carrier and a second position where the front end comes into abutment against the recording sheet and presses the recording sheet against the image carrier.

In the transfer device according to the above aspect of the invention, by allowing the blade front end to normally assume the first position spaced away from the image carrier and to assume the second position in synchronism with advancing of the recording sheet, the image carrier can be prevented from being damaged by the transfer assisting blade(s).

According to another aspect of the present invention, there is provided an image forming device including the transfer device described in any of the above aspects of the invention.

According to another aspect of the present invention, there may be provided the transfer device further including a position shifting means for shifting a position of the transfer assisting blade.

Since the image forming device according to the above aspect of the invention includes the transfer device described in any of the above aspects of the invention, it is superior in transfer performance and hence an image of good quality can be formed on the recording sheet.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device for transferring onto a recording sheet, a toner image formed on an image carrier, the transfer device comprising:

a transfer assisting blade adapted to abut the recording sheet and press the recording sheet against the image carrier, the blade having a slant portion 1) formed in a transverse direction at a front end of the blade, and 2) having an angle relative to an advancing direction of the recording sheet, wherein the slant portion is for abutment against the recording sheet.

2. The transfer device according to claim 1, wherein the front end of the transfer assisting blade is inclined from one end portion orthogonal to the advancing direction of the recording sheet toward an opposite end portion.

3. The transfer device according to claim 1, wherein the front end of the transfer assisting blade is expanded centrally in the advancing direction of the recording sheet.

4. The transfer device according to claim 3, wherein the transfer assisting blade is movable in a direction orthogonal to the advancing direction of the recording sheet.

5. The transfer device according to claim 1, wherein a shape of the front end of the transfer assisting blade includes a curved line.

6. The transfer device according to claim 1, wherein a shape of the front end of the transfer assisting blade includes a straight line.

7. The transfer device according to claim 1, wherein a shape of the front end of the transfer assisting blade includes a combination of both curved and straight lines.

8. The transfer device according to claim 1, wherein a shape of the front end of the transfer assisting blade can be transformed.

9. The transfer device according to claim 8, wherein the transfer assisting blade comprises a plurality of overlapped blades arranged in a direction orthogonal to the advancing direction of the recording sheet, positions of the overlapped blades being shifted relatively and front ends of the overlapped blades being transformable.

10. The transfer device according to claim 1, wherein the front end of the transfer assisting blade moves between a first position spaced away from the image carrier and a second position where the front end comes into abutment against the recording sheet and presses the recording sheet against the image carrier.

11. An image forming device comprising the transfer device described in claim 1.

12. The transfer device according to claim 1, further comprising a position shifting means for shifting a position of the transfer assisting blade.

13. A transfer device for transferring onto a recording sheet a toner image formed on an image carrier, the transfer device comprising:

a plurality of transfer assisting blades adapted to abut the recording sheet and press the recording sheet against the image carrier, the blades being disposed spacedly in an advancing direction of the recording sheet, at least one of the blades having a slant portion 1)formed in a transverse direction at a front end of the blade, and 2) having an angle relative to the advancing direction of the recording sheet, wherein the slant portion is for abutment against the recording sheet.

14. The transfer device according to claim 13, wherein the front end of the at least one of the transfer assisting blades is inclined from one end portion orthogonal to the advancing direction of the recording sheet toward an opposite end portion.

15. The transfer device according to claim 13, wherein the front end of the at least one of the transfer assisting blades is expanded centrally in the advancing direction of the recording sheet.

16. The transfer device according to claim 15, wherein the at least one of the transfer assisting blades is movable in a direction orthogonal to the advancing direction of the recording sheet.

17. The transfer device according to claim 13, wherein a shape of the front end of the at least one of the transfer assisting blades includes a curved line.

18. The transfer device according to claim 13, wherein a shape of the front end of the at least one of the transfer assisting blades includes a straight line.

19. The transfer device according to claim 13, wherein a shape of the front end of the at least one of the transfer assisting blades includes a combination of both curved and straight lines.

20. The transfer device according to claim 13, further comprising a position shifting means for shifting a position of the at least one of the transfer assisting blades.

* * * * *